US010550734B2

(12) United States Patent
Weber et al.

(10) Patent No.: US 10,550,734 B2
(45) Date of Patent: Feb. 4, 2020

(54) CAMSHAFT PHASER

(71) Applicant: SCHAEFFLER TECHNOLOGIES AG & CO. KG, Herzogenaurach (DE)

(72) Inventors: Juergen Weber, Erlangen (DE); Christian Boesel, Rednitzhembach (DE); Jochen Thielen, Nuremberg (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 13 days.

(21) Appl. No.: 15/659,657

(22) Filed: Jul. 26, 2017

(65) Prior Publication Data

US 2018/0030862 A1 Feb. 1, 2018

(30) Foreign Application Priority Data

Jul. 27, 2016 (DE) ..... 10 2016 213 797

(51) Int. Cl.
*F01L 1/344* (2006.01)
*F01L 1/02* (2006.01)
*F01L 1/047* (2006.01)

(52) U.S. Cl.
CPC ..... *F01L 1/3442* (2013.01); *F01L 1/024* (2013.01); *F01L 1/34409* (2013.01); *F01L 1/047* (2013.01); *F01L 2001/34479* (2013.01)

(58) Field of Classification Search
CPC ..... F01L 1/3442; F01L 1/022; F01L 1/024; F01L 1/34409; F01L 1/047; F01L 2001/0475; F01L 2001/34479
USPC ..... 123/90.17, 90.15
See application file for complete search history.

(56) References Cited

U.S. PATENT DOCUMENTS

2009/0031974 A1* 2/2009 Lichti ..... F01L 1/34 123/90.17
2012/0145104 A1* 6/2012 David ..... F01L 1/344 123/90.17
2012/0152188 A1* 6/2012 Weber ..... F01L 1/3442 123/90.15

FOREIGN PATENT DOCUMENTS

DE 102011050084 A1 * 11/2012 ..... F01L 1/3442
DE 102012102022 A1 9/2013

* cited by examiner

*Primary Examiner* — Laert Dounis
*Assistant Examiner* — Kelsey L Stanek
(74) *Attorney, Agent, or Firm* — Brooks Kushman P.C.

(57) ABSTRACT

A camshaft phaser for the adjusting valve timing of a combustion engine includes a stator and a rotor that can rotate relative to the stator. The rotor is connected to one end of the camshaft via an adapter as well as via a sprocket which is fixedly mounted to the stator. The sprocket is slideably mounted about the camshaft with a first guiding section and is slideably mounted about the adapter with a second guiding section.

14 Claims, 2 Drawing Sheets

CAMSHAFT PHASER

CROSS-REFERENCE TO RELATED APPLICATIONS

This application claims priority to DE Patent Application No. 102016213797.2 filed Jul. 27, 2016, the disclosure of which is incorporated in its entirety by reference herein.

TECHNICAL FIELD

This disclosure relates to a camshaft phaser as well as a method for producing a camshaft phaser.

BACKGROUND

Camshaft phasers are used in combustion engines in order to adjust the valve timing of the intake and exhaust valves of a combustion engine to a load condition of the combustion engine and thus to increase the efficiency of the combustion engine. Both electrically working camshaft phasers as well as hydraulic camshaft phasers are known from the prior of art. A well-known version of a hydraulic camshaft phaser works in accordance with the vane principle. Hereby, the camshaft phaser comprises a stator and a rotor that can be twisted in relation to the stator, whereby several hydraulic chambers are formed between the stator and the rotor, which are divided into two respective working chambers by the rotor blades. By means of a corresponding hydraulic pressurizing of the working chambers, it is possible to vary the position of the rotor in relation to the stator and thus to adjust the timing of the valves. It is hereby possible to connect the rotor to one end of the camshaft either directly or via an adapter.

A hydraulic camshaft phaser for a combustion engine is known from the DE 10 2011 050 084 A1. A camshaft adapter is hereby arranged between the rotor of the camshaft phaser, which is axially braced with its end faces between the rotor hub and a camshaft part. The stator of the camshaft phaser is thereby arranged within a timing belt pulley. The stator and the timing belt pulley are designed in one single piece. The camshaft phaser can be operated by the crankshaft of the combustion engine via a not depicted timing belt.

A camshaft phaser for a combustion engine, which comprises a sintered rotor with a polished end face, is known from the DE 10 2012 102 022 A1. A camshaft adapter is thereby arranged between the polished end face of the rotor and the camshaft, in order to center the rotor in relation to the camshaft.

However, the disadvantage of these known solutions is, that the drive of the camshaft phaser is arranged within the axial extension of the camshafts, and thus requires additional construction space.

In addition to this, camshaft phasers are known from the prior art, in which the camshaft phasers are operated via a chain sprocket that is supported on an adapter that is arranged between the rotor and the crankshaft. In this way, it is possible to arrange the chain sprocket on the side of the camshaft phaser that is facing towards the camshaft.

SUMMARY

It is the objective of this disclosure to present a camshaft phaser which can be designed in a compact way and which can be produced in a cost-efficient manner.

This objective is accomplished in accordance with various embodiments of the invention by means of a camshaft phaser for the adjusting of the valve timing of a combustion engine with a stator and a rotor that can be twisted in relation to the stator, whereby the rotor is connected to one end of the camshaft via an adapter as well as via a chain sprocket which is arranged on the stator of the camshaft phaser in a way that it is rotationally fixed, and whereby the chain sprocket is mounted on the camshaft with a first guiding section and on the adapter with a second guiding section. Thus, a compact construction of the camshaft phaser is possible, whereby the adapter can be designed in a geometrically simple and thus cost-efficient manner.

By means of the characteristics that are listed in the dependent claims, advantageous modifications and improvements of the camshaft phaser mentioned in the independent claim are possible.

In a preferred embodiment of the camshaft phaser, it is intended that a passage opening for the centering of the camshafts and of the adapter is created on the chain sprocket. In this way, the adapter can be centered from the chain sprocket to the camshaft phaser, and the radially necessary construction space is reduced in comparison to an adapter that is directly centered by the camshaft. It is particularly preferred, if the adapter and the chain sprocket are produced in one respective sintering process. This makes a particularly cost-effective production without any subsequent metal-cutting manufacturing possible, so that the danger of production-related contaminations, in particular of chips or particles, is prevented. Thus, particularly mechanical processing by means of an additional centering surface can be omitted.

In one embodiment, a ledge is formed on the adapter, in particular a cylindrical ledge for the bearing of the rotor. Thus, a particularly simple centering and bearing of the rotor in relation to the adapter and thus to the camshaft is possible, so that the danger of tipping errors is further reduced. It is thus possible to achieve a high precision of the coaxiality between the rotor and the camshaft.

In another embodiment, it is intended that a contact surface between the rotor and the adapter and/or a contact surface between the adapter and the camshaft is equipped with a friction-enhancing structure, in particular with a laser structure. By means of a structuring of the contact surfaces, it is possible to increase the torque that is transmitted via the frictional connection, since an additional micro gearing is designed which increases the transmitted torque. It is alternatively or additionally intended that the contact surfaces are processed with a special heat treatment, in order to reduce the deformation of the components after the assembly and to increase the transmitted torque.

In an additional embodiment, it is intended that an elevation or a depression is formed at the adapter for a form-fitting connection with the rotor or with the camshaft. This can improve an angular orientation of components towards each other. It is furthermore possible to ensure that a twisting between these components can be prevented by means of another geometrical element. Although a twisting between rotationally symmetrical components towards each other is basically possible, a twisting in relation to the rotational characteristics of the adapter and of the angularity can have a negative effect on the coaxiality of the components towards each other. It is therefore advantageous, if a twisting of the adapter in relation to the rotor or to the camshaft is prevented by means of a form-fitting.

According to a further embodiment, a recess for accommodating a protection against twisting is provided on the adapter. As an alternative to a protruding geometrical element, it is also possible to form a recess in the adapter, in particular a passage opening, particularly preferred a cylindrical passage bore hole. The protection against twisting preferably comprises a bolt, in particular a cylindrical bolt, which works in connection with a recess, in particular with a bore hole or groove in the camshaft or in the rotor, and which thus forms a form-fitting connection. The recess or the passage bore hole can furthermore be used for the oil supply of the camshaft phaser. It is also possible that at least two recesses or passage bore holes are provided in the adapter, whereby at least one is intended for accommodating a protection against twisting and at least another for the oil supply through the adapter.

This disclosure further relates to a method for producing a camshaft phaser with a stator, a rotor and a chain sprocket, which is connected to one end of the camshaft of a combustion engine, whereby an adapter is arranged between the rotor and the camshaft, whereby the chain sprocket is mounted on the camshaft with a first guiding section, whereby the chain sprocket is mounted on the adapter with a second guiding section, whereby the adapter is connected to the camshaft, and whereby a compound structure, consisting of at least the adapter and the camshaft can be inserted into a passage opening of the chain sprocket and thereby be centered. Thus, a particularly simple assembly of the camshaft phaser without any additional adjustments is possible.

The various embodiments of the invention that are mentioned in this disclosure can be advantageously combined with each other, unless it is not stated differently for an individual case.

DETAILED DESCRIPTION

Figure 1:
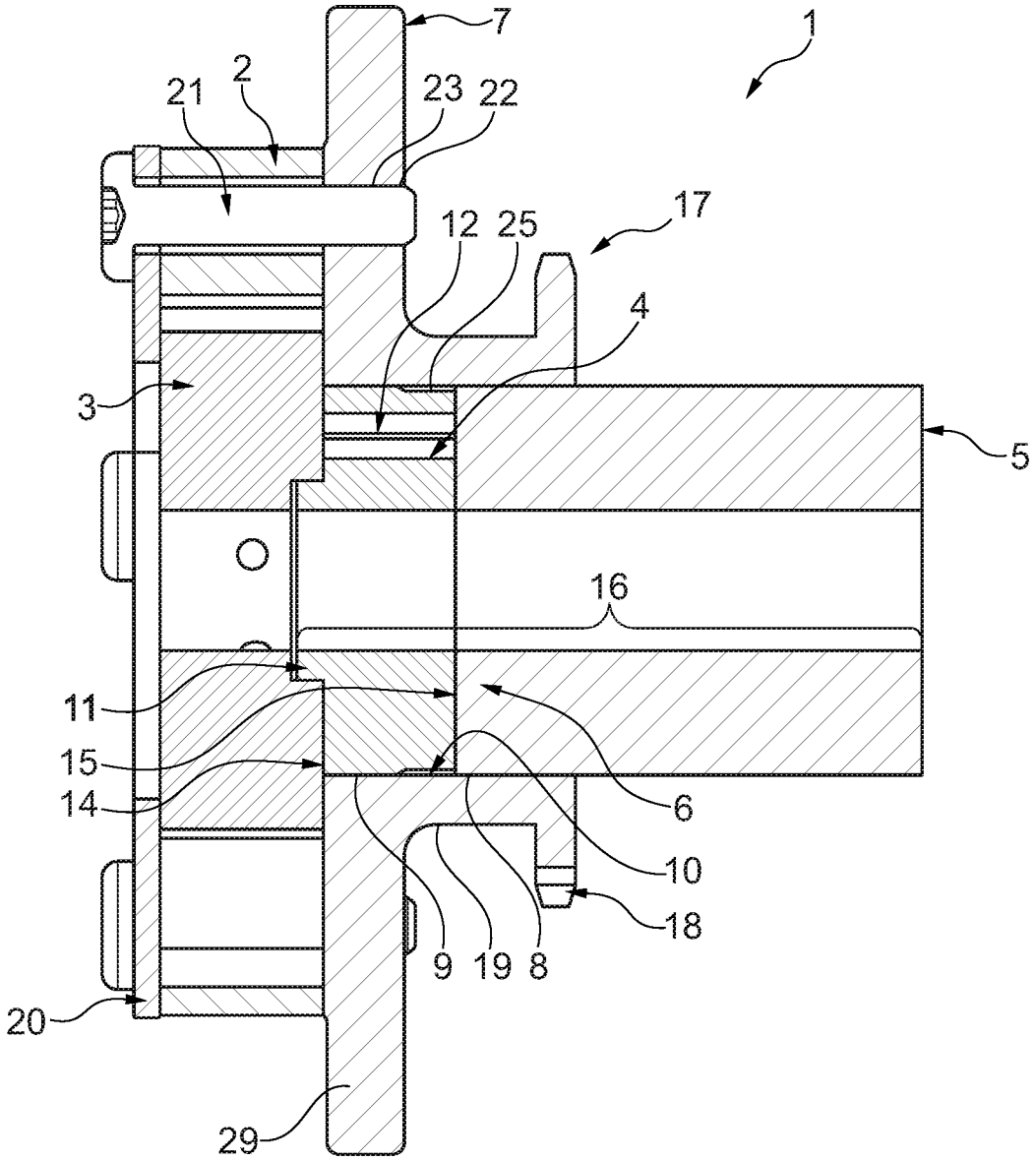
FIG. 1 illustrates a hydraulic camshaft phaser in accordance with the vane principle, in which the chain sprocket is mounted on the camshaft with a first guiding section and on the adapter with a second guiding section.

FIG. 1 depicts a hydraulic camshaft phaser 1 for adjusting the opening and closing times of the intake or exhaust valves of a combustion engine. The camshaft phaser 1 comprises a stator 2 and a rotor 3, whereby the rotor 3 is mounted in the stator 2 in such a way that it rotates with the stator 2 around a common rotation axis. Rotor 3 is connected via an adapter 4 to one end 6 of a camshaft 5 of the combustion engine. On its end that is facing away from the camshaft 5, stator 2 is closed by a cover 20, whereby the cover 20 is connected to a chain sprocket 7 of the camshaft phaser by means of openings in stator 2. To accomplish this, bore holes 22 with a thread 23 are arranged in the chain sprocket 7, so that the cover 20 can be attached to the chain sprocket 7 by means of screws 21, which can be inserted into the openings in stator 2 and tightened in these threads 23. A passage opening 10 is arranged at the chain sprocket 7, which forms a guiding surface for the chain sprocket 7. At the end 6 of the camshaft 5, a first guiding section 8 is formed, which can engage with the guiding surface of the chain sprocket 7. A second guiding section 9 is formed at adapter 4, which can also engage with the guiding surface on the chain sprocket 7. Between the first guiding section 8 at the end of camshaft 5 and the second guiding section 9 at adapter 4, a free punch 25 is provided on the adapter 4 in order to accommodate a locking for the chain sprocket 7. Alternatively, adapter 4 can also be arranged with a constant diameter on its outer diameter.

A first section 29 is designed on the chain sprocket 7, which is provided for the fastening of the chain sprocket 7 at stator 2. In addition to this, a ledge 17 is provided at the chain sprocket 7, which is arranged with a gear tooth system 18 in order to accommodate a chain, by means of which the camshaft phaser can be connected to a camshaft of the combustion engine. Between the first section 29 and the ledge 17, a recess 19 is provided in order to arrange for the necessary clearance for the chain. It is furthermore possible to implement specifications with regards to the position of the chain in relation to camshaft 5 via the width of the chain sprocket 7 in a constructive manner, without having to change further components.

The adapter 4 is designed as a simple, mainly cylindrical body and features a ledge 11 at its end that is facing towards rotor 3, for the centering of the position of adapter 4 and of rotor 3 towards each other. The adapter 4 further comprises recesses 12 into which centering pins or other means can be inserted for an angular alignment, in order to ensure a position orientation with regards to rotor 3 towards adapter 4 and/or with regards adapter 4 towards camshaft 5. Alternatively or additionally, it is possible to provide recesses 12 at adapter 4, in particular passage bore holes for the oil supply between camshaft 5 and rotor 3. Hereby adapter 4 is positioned with a first contact surface 14 flat on rotor 3 of the camshaft phaser 1, and with a second contact surface 15 flat on the end 6 of camshaft 5.

The connection of rotor 3 to camshaft 5 is carried out via adapter 4 by means of a central screw (not illustrated) or by means of another kind of fixation. The danger of a tilting of the adapter 4 in relation to camshaft 5 is to be reduced as much as possible in this way, in order to achieve the best possible rotation and to reduce the oil leakage at the axial bearing of the camshaft phaser 1. The free punch 25 furthermore provides the possibility to compensate slight errors in the coaxiality and in the rotation, so that the components of the camshaft phaser 1 can be designed in a comparatively simple and cost-effective manner. Adapter 4 is centered by the chain sprocket 7 towards the end 6 of camshaft 5, by means of which a geometrically simple and comparatively cost-effective adapter 4 is possible. There is furthermore the possibility to save construction space in radial direction, since such an adapter 4 requires less construction space than an adapter 4 which would be centered directly by camshaft 5.

Adapter 4 of the suggested camshaft phaser 1 is hereby centered along with the end 6 of camshaft 5 by means of the guiding surface of the chain sprocket 7. It is hereby possible that adapter 4 and the chain sprocket 7 can be produced particularly cost-effective in one sintering process, whereby an additional, cost-intensive processing of additional centering surfaces can be omitted. As a result, the assembly of the camshaft phaser 1 is simplified as well, since it is no longer necessary to adjust a second centering surface and thus one working process can be eliminated. A compound structure 16 that is made from adapter 4 and camshaft 5 can thereby be inserted into the passage opening 10 of chain sprocket 7, whereby adapter 4 as well as camshaft 5 can be centered at their respective guiding sections 8, 9 by means of the guiding surface of the chain sprocket 7.

By means of the elements such as e.g. centering pins, that can be inserted into the recesses 12, which are preferably designed as passage openings, it is possible to ensure the angular alignment between adapter 4 and rotor 3 as well as between adapter 4 and camshaft 5, since these elements prevent a twisting between the respective components.

The contact surface 14 between rotor 3 and adapter 4 as well as the contact surface 15 between adapter 4 and the end 6 of camshaft 5 can be equipped with a friction-enhancing structure, in particular with a laser structure, or a corresponding heat treatment, in order to reduce deformation of the components after the assembly by means of a form-fitting connection or to transmit a higher torque at the same pretensioning force.

Figure 2B:
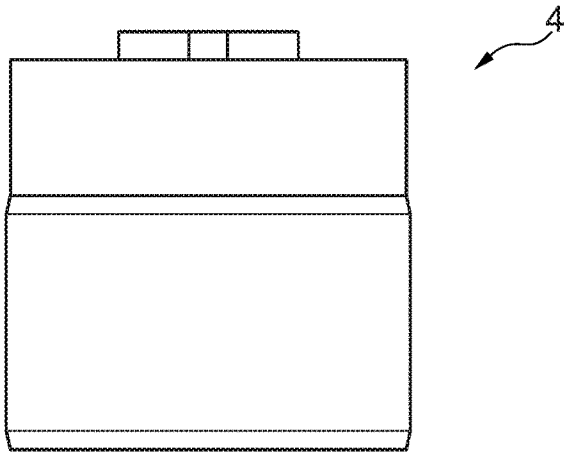
FIG. 2B illustrates a side view of the adaptor.
Figure 2C:
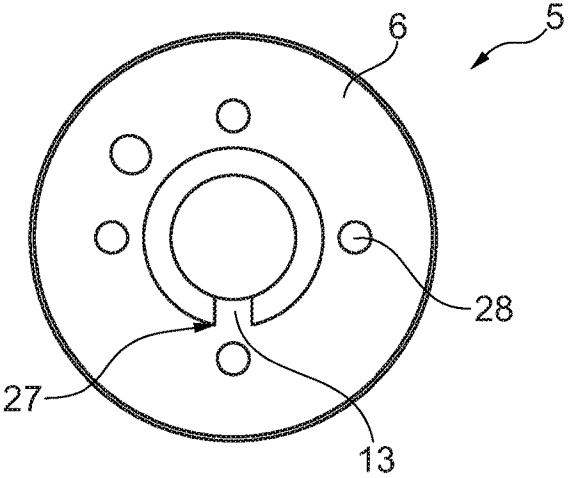
FIG. 2C illustrates an end view of the camshaft, according to an embodiment.
Figure 2A:
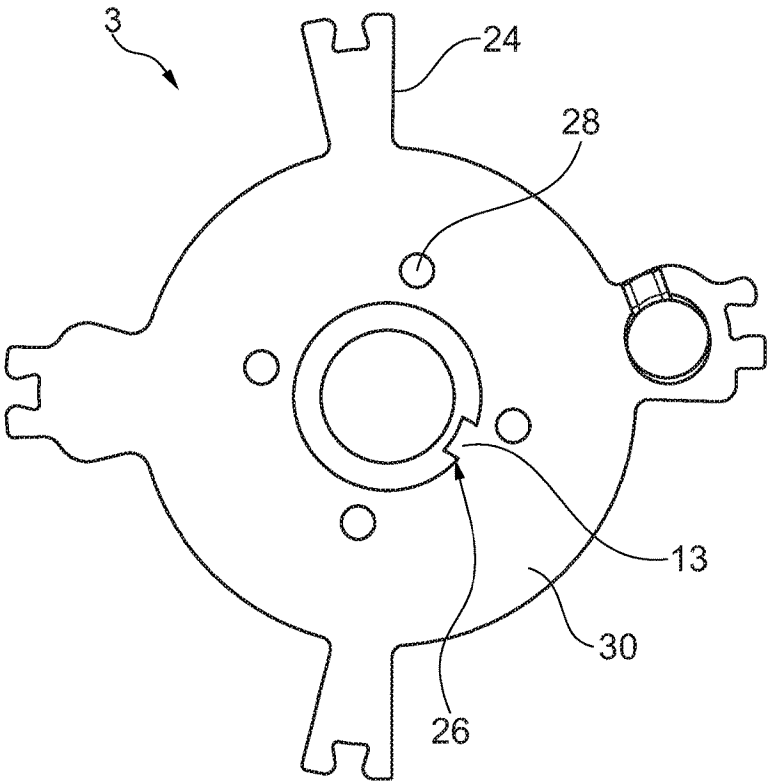
FIG. 2A illustrates a front end view of the rotor.

FIGS. 2A-2C depicts rotor 3, adapter 4 as well as the end 6 of camshaft 5 of the camshaft phaser 1 according to this disclosure. Rotor 3 features a base body 30, from which the blades 24 protrude radially in relation to the rotation axis of rotor 3 into the direction of stator 2. Rotor 3 furthermore comprises openings 28 to accommodate elements, which are arranged in the recesses 12 of adapter 4, in order to prevent a twisting of adapter 4 in relation to rotor 3. The openings 28 in rotor 3 and the recesses 12 in adapter 4 can furthermore be used for the oil supply of the camshaft phaser 1. The rotor 2 further comprises a protection against twisting 13 in form of a recess 26 or of a ledge, by means of which a form-fitting connection can be accomplished towards a corresponding ledge or a corresponding recess at adapter 4. At its end that is facing towards adapter 4, camshaft 5 also comprises a protection against twisting 13 in form of a recess 27 or of a ledge, which can be engaged by means of a corresponding elevation or recess at adapter 4. Additionally or alternatively, it is also possible to provide openings 28 at the end 6 of camshaft 5, in order to accommodate the elements that are inserted into the recesses of adapter 12 and thus to produce a form-fitting connection between adapter 4 and the end 6 of camshaft 5.

LIST OF REFERENCE SIGNS

1 Camshaft Phaser
2 Stator
3 Rotor
4 Adapter
5 Camshaft
6 End of the Camshaft
7 Chain Sprocket
8 first Guiding Section
9 second Guiding Section
10 Passage Opening
11 Ledge
12 Recess
13 Protection against Twisting
14 first Contact Surface
15 second Contact Surface
16 Compound Structure
17 Ledge
18 Gear Tooth System
19 Recess
20 Cover
21 Screw
22 Bore Hole
23 Thread
24 Blade
25 Free Punch
26 Recess
27 Recess
28 Opening
29 first Section
30 Base Body

What is claimed is:

1. A camshaft phaser for adjusting a valve timing of a combustion engine, the camshaft phaser comprising:

a stator;

a rotor rotatable relative to the stator, wherein the rotor is connected via an adapter to an end of a camshaft, a chain sprocket connected to the stator, the chain sprocket having a cylindrical inner guiding surface;

wherein the guiding surface of the chain sprocket is mounted about a first guiding section of the camshaft and about a second guiding section of the adapter;

wherein a contact surface between the rotor and the adapter, as well as a contact surface between the adapter and the camshaft, are equipped with surface features configured to enhance friction.

2. The camshaft phaser according to claim 1, wherein a passage opening for the centering of the camshaft and of the adapter is within the chain sprocket.

3. The camshaft phaser according to claim 1 wherein a ledge is formed on the adapter and configured to center the adapter with the rotor.

4. The camshaft phaser of claim 1 wherein the adapter and the chain sprocket are produced in one respective sintering process.

5. The camshaft phaser of claim 1, wherein an elevation or a depression is formed at the adapter for a form-fitting connection with the rotor or with the camshaft.

6. The camshaft phaser of claim 1, wherein a recess is formed at the adapter for receiving a pin configured to inhibit twisting or supply oil through the adapter.

7. The camshaft phaser of claim 6, wherein the recess is a passage opening.

8. A camshaft phaser assembly comprising:

a stator, a rotor and a chain sprocket connected to one end of a camshaft of a combustion engine, the chain sprocket having a cylindrical inner surface defining a guiding surface;

an adapter arranged between the rotor and the camshaft; wherein the guiding surface of the chain sprocket is mounted on the camshaft with a first guiding section, and mounted on the adapter with a second guiding section; wherein the adapter is connected to the camshaft; and a compound structure including at least the adapter and the camshaft inserted into and centered with respect to a passage opening of the chain sprocket wherein a recess is formed at the adapter, and the recess receives a pin.

9. A camshaft phaser for adjusting valve timing of an internal combustion engine, the camshaft phaser comprising:

a stator;

a rotor rotatable relative to the stator;

a sprocket fixedly mounted to the stator, the sprocket having a cylindrical inner surface configured to contact an outer surface of a camshaft in a slideable manner to enable relative rotation between the sprocket and camshaft, and an outer surface defining a recess configured to receive a chain or belt; and an adapter axially aligned with the rotor and configured to transfer rotational movement between the rotor to the camshaft, the adapter located radially inward of the sprocket and having an outer surface contacting the inner surface of the sprocket in a slideable manner to enable relative rotation between the adapter and the sprocket;

wherein a recess is formed at the adapter, and the recess receives a pin.

10. The camshaft phaser of claim 9, wherein the adapter has an end surface that engages a corresponding end surface of the camshaft such that the adapter and camshaft are coupled in an end-to-end relationship.

11. The camshaft phaser of claim 9, wherein the rotor, the adapter, and the camshaft are axially aligned and define a common through hole.

12. The camshaft phaser of claim 9, wherein the rotor, the adapter, and the camshaft define a common through hole that is located within a center hole of the sprocket.

13. The camshaft phaser of claim 9, wherein the adapter is disposed axially between the rotor and the camshaft.

14. The camshaft phaser of claim 9, wherein the adapter defines a ledge on an end surface that faces the rotor, and the rotor defines a corresponding groove that receives the ledge to center the rotor with respect to the adapter.

* * * * *